US005433033A

United States Patent [19]

Rickards

[11] Patent Number: 5,433,033

[45] Date of Patent: Jul. 18, 1995

[54] EXCAVATING TOOTH AND SHANK PLATE ASSEMBLY

[75] Inventor: Brian Rickards, Fremont, Calif.

[73] Assignee: Pengo Corporation, Union City, Calif.

[21] Appl. No.: 228,997

[22] Filed: Apr. 18, 1994

[51] Int. Cl.[6] ..... F02F 9/28

[52] U.S. Cl. ..... 37/452; 37/189; 175/391; 299/91; 299/92

[58] Field of Search ..... 37/406, 405, 394, 195, 37/453, 446, 351, 397, 403; 175/391, 392, 393, 394, 385; 299/89, 91, 92

[56] References Cited

U.S. PATENT DOCUMENTS

| | | | |
|---|---|---|---|
| 783,764 | 2/1905 | Thomas | 37/452 |
| 1,060,141 | 4/1913 | Snyder | 37/452 X |
| 2,005,016 | 6/1935 | Buskirk | 37/452 |
| 2,578,014 | 12/1951 | Petersen . | |
| 2,877,574 | 3/1959 | Petersen . | |
| 2,952,085 | 9/1960 | Petersen . | |
| 3,063,175 | 11/1962 | Petersen . | |
| 3,136,077 | 6/1964 | Troeppl | 37/452 |
| 3,225,467 | 12/1965 | Troeppl | 37/452 |
| 3,388,488 | 6/1968 | Duplessis | 37/452 |

*Primary Examiner*—Dennis L. Taylor
*Assistant Examiner*—Robert Pezzuto
*Attorney, Agent, or Firm*—Townsend and Townsend Khourie and Crew

[57] ABSTRACT

An excavating tooth includes an aperture for bolting the tooth to a shank plate and a lug configured to provide a friction fit in a recess formed in the shank plate. The bolt and lug combination prevent relative movement between the tooth and shank plate. In addition, tooth load is absorbed in the shank plate through the connection between the lug and shank plate, thereby reducing the stress transferred through the bolt.

11 Claims, 4 Drawing Sheets

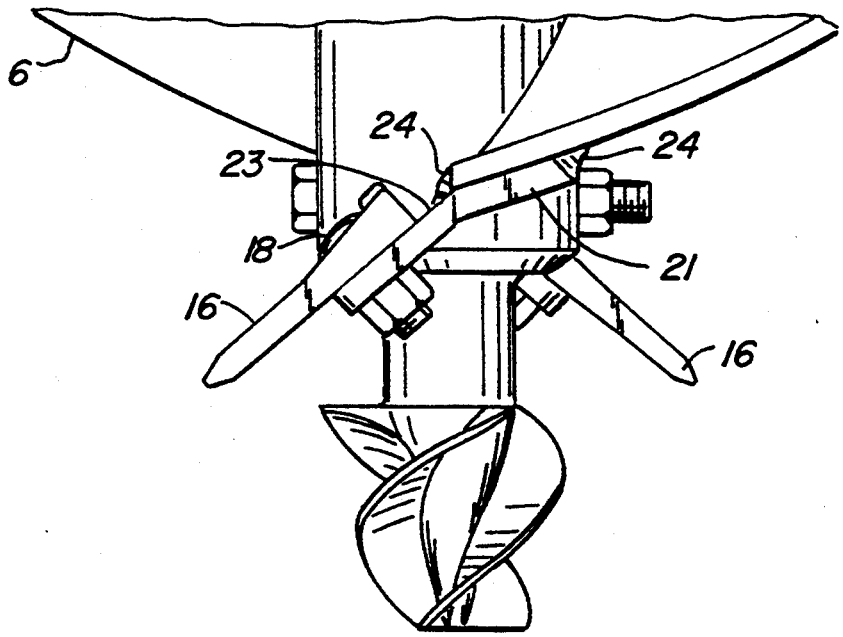
FIG. 2.
FIG. 3.
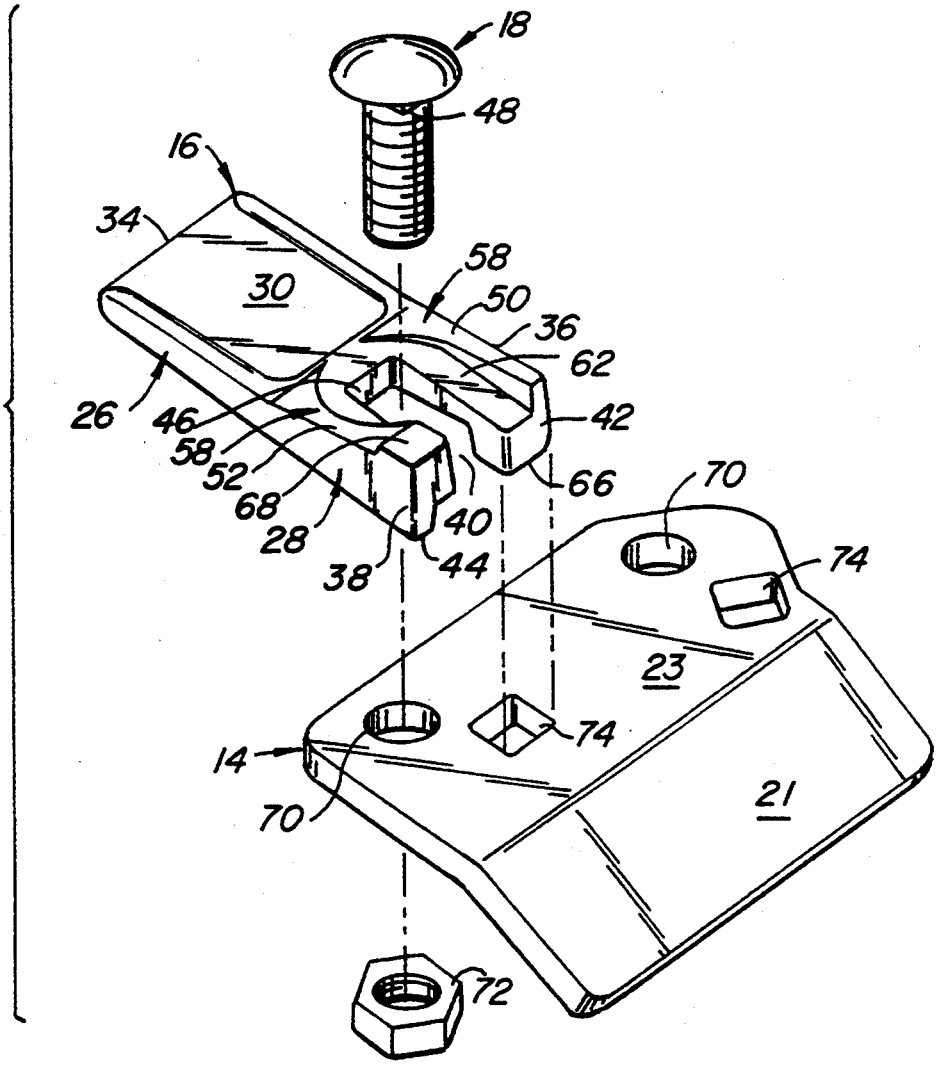

EXCAVATING TOOTH AND SHANK PLATE ASSEMBLY

CROSS-REFERENCE TO RELATED APPLICATION

This patent application is related to U.S. patent application Ser. No. 08/229,262, filed Apr. 18, 1994, titled Reversible Tooth with Adjustable Attack Angle.

BACKGROUND OF THE INVENTION

The present invention relates to an excavating tooth for earth-digging equipment such as earth augers and the like, and a mounting arrangement therefor.

Typically, earth-digging machines employ boring heads having a plurality of teeth which dig into the earth being excavated. These teeth absorb most of the load encountered by the machine and are the portion of the machine most likely to be worn or broken. Accordingly, tooth configurations and mounting arrangements therefor have been developed to facilitate replacement of broken teeth. Reversible tooth arrangements also have been developed that permit a tooth worn on one side to be turned over and used on the other side.

Generally, such teeth include a distal cutting portion and a proximal portion that is configured for bolting the tooth to a holder such as a shank plate as disclosed in U.S. Pat. Nos. 2,952,085 and 3,063,175 to Petersen, for example. Typically, the proximal portion includes a pair of laterally spaced prongs that form a slot therebetween through which a bolt extends to connect the tooth to the tooth holder. A back wall is provided on the tooth holder behind the prong ends of the tooth as disclosed in U.S. Pat. No. 3,063,175 to Petersen, for example. This wall is intended to prevent tooth rotation about the rotational axis of the bolt. The tooth holder can be cast steel in which the back wall typically is formed in the holder during casting. Alternatively, the tooth holder can comprise a stamped steel plate, in which case a tab is generally welded to the plate to form the back wall of the tooth holder. However, due to manufacturing tolerances of the teeth as well as the tooth holder, both tooth prong ends generally do not seat against the back wall when the tooth is bolted to the holder. As a result, a substantial amount of the load on the tooth can be transferred to the holder through the bolt, thereby causing bolt failure and machine down time. Such spacing between the prong ends and the back wall also can result in tooth oscillation as contact is alternately made between each tooth prong and the back wall. The resultant cyclic impact between the prongs and the back wall can significantly reduce the life of the tooth. In addition, where the welded tab configuration is used to form the back wall, the load transferred from the tooth to the tab, can break the tab from the tooth holder. It is also noted that on the tooth holders that have back wall tabs welded to the plate, the bolt generally acts as a clamp and prevents the tooth from moving forward and away from the tab. However, if the bolt is loosened the slightest amount, as a result of vibration for example, the tooth can move forward such that the prongs are no longer in contact with the back wall. The tooth will then oscillate about the bolt and loosen the bolt even further. As a result, the tooth can fall off of the auger or simply loosen to the point where it becomes ineffective.

SUMMARY OF THE INVENTION

The present invention is directed to an excavating tooth and mounting arrangement that avoids the problems and disadvantages of prior art. The invention accomplishes this goal by providing a tooth configured for forming a positive interlock with a tooth holder, such as a shank plate, at all times. More specifically, the tooth includes a distal portion and a proximal portion having a mounting surface and an aperture for receiving a fastener, such as a bolt, for securing the mounting surface of the tooth to the shank plate. The tooth is provided with a lug that extends beyond the mounting surface of the tooth for cooperating with a recess formed in the shank plate. In this manner, the need for welding a tab to the shank plate to cooperate with the tooth and minimize tooth rotation is eliminated.

The lug is configured to snugly fit in the recess so that the lug always is sufficiently in contact with the inner wall(s) of the recess to prevent relative movement therebetween. In this manner, the lug prevents tooth rotation or oscillation about the bolt when the tooth is bolted to the plate and the lug is secured in the recess. The lug also prevents the tooth from slipping, e.g., sliding laterally, forwardly or rearwardly. With the tooth secured against slip and rotational or oscillatory movement, it can more effectively dig into the earth being excavated. Since the lug restrains the movement of the tooth, slight loosening of the bolt does not permit significant movement of the tooth, i.e., movement that would render it ineffective. In addition, as the tooth digs into the earth, forces placed on the tooth are transferred to the shank plate through the lug due to the positive contact between the lug and shank plate. This reduces stress transfer through the fastener, thereby increasing the life of the fastener. In accordance with the preferred embodiment, the lug is tapered to provide the desired snug fit in the shank plate recess and prevent relative movement between the lug and shank plate, while allowing for manufacturing tolerances.

According to another aspect of the invention, the proximal portion of the tooth includes mounting surfaces on opposite sides thereof and a lug extending beyond each surface. In this manner, the tooth can be readily reversed by loosening the bolt and removing one lug from the recess, turning the tooth over and inserting the other lug into the recess and tightening the bolt.

According to another aspect of the invention, the proximal portion of the tooth also is provided with differently oriented mounting surfaces, which are adapted for alternate mounting to a shank plate. More specifically, the mounting surfaces converge toward the distal portion and form different angles with a plane generally bisecting the distal portion. With this construction, the attack angle of the tooth can be changed by turning the tooth over and alternating the mounting surface secured to the tooth holder or shank plate. Thus, a tooth constructed to provide interchangeable 40° and 50° attack angles can be used to dig soft agricultural soil at a 40° attack angle and then reversed when a relatively hard stratum is encountered.

A further advantageous aspect of the present invention is the provision of bolt head seating surfaces in the proximal portion which permit the locking bolt to be maintained substantially perpendicular to the tooth so that the tooth can be securely fastened to a shank plate. In the preferred embodiment, one seating surface is parallel to one of the mounting surfaces and the other seating surface is parallel to the other mounting surface.

The above is a brief description of some deficiencies in the prior art and advantages of the present invention. Other features, advantages and embodiments of the invention will be apparent to those skilled in the art from the following description, accompanying drawings and appended claims.

BRIEF DESCRIPTION OF THE DRAWINGS

FIG. 2 is the auger assembly of FIG. 1 rotated 90°;

FIG. 3 is an exploded view of one of the shank plates of FIG. 1;

DESCRIPTION OF THE PREFERRED EMBODIMENT

Figure 1:
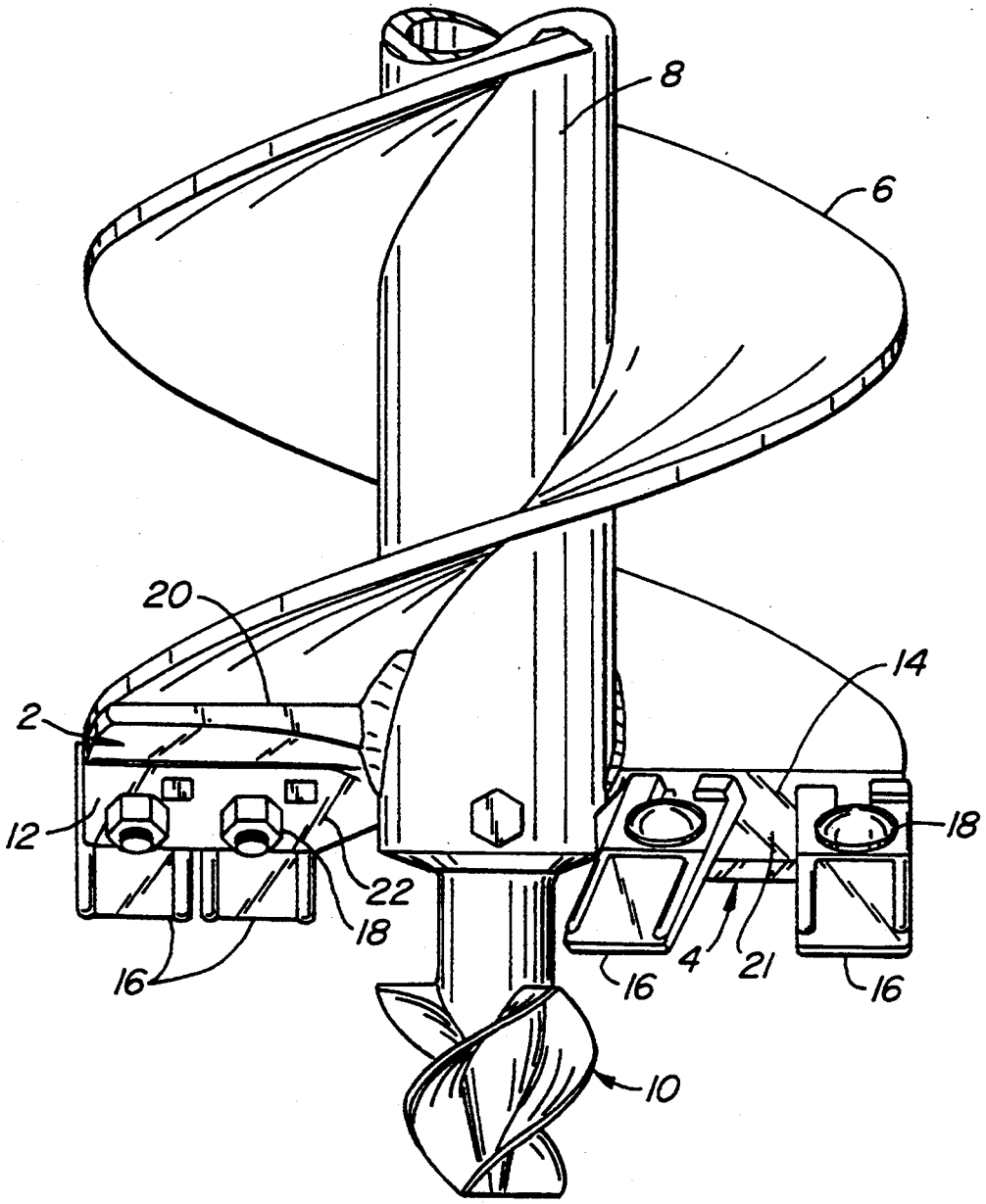
FIG. 1 is a side view of an auger assembly in accordance with the principles of the present invention.

Referring to the drawings in detail, wherein like numerals indicate like elements, FIG. 1 illustrates tooth and shank assemblies 2 and 4 constructed in accordance with the present invention. Shank assemblies 2 and 4 are shown secured to flighting 6 which is helically wound around auger shaft 8 to convey spoil to the surface of the area being excavated as is conventional in the art. In the embodiment illustrated in FIG. 1, pilot head 10 also is provided to cut clearance for auger shaft 8. Although a four tooth arrangement is shown, which is suitable for 12, 16, 18, 24 and 30 inch diameter boring heads, for example, other arrangements can be used to accommodate these other boring head dimensions as would be apparent to one of ordinary skill.

Shank plate assemblies 2 and 4 generally include shank plates 12 and 14, drilling elements or teeth 16, and fasteners 18, which secure the teeth to the shank plates. Shank plates 12 and 14 each include a first portion 20, 21 for securing the shank plate to the flighting and a second portion 22, 23 to which the teeth are secured. Referring to FIG. 2, first portions 20 and 21 can be secured to the flighting by welding, as indicated by reference numeral 24, for example. Shank plates 14 and 16 differ in the arrangement of their tooth mounting holes, which will be discussed in more detail below, so that one of the teeth can be angled radially inwardly, as shown in FIG. 1, to ensure that clearance is cut for auger shaft 8. Since the configuration of each tooth 16 and its attachments to shank plate 12 or 14 is essentially identical, only a single tooth and its attachment to a shank plate will be discussed in detail below.

Tooth 16 includes a distal portion 26 and a proximal portion 28. Distal portion 26 includes top and bottom faces 30 and 32 which terminate in digging or cutting end 34. The distal portion can be tapered as is conventional in the art and shown in the drawings in which faces 30 and 32 are angled downwardly in the forward direction toward end 34. Proximal portion 28, which is configured for fastening the tooth to the shank plate, includes two laterally spaced prongs 36 and 38 which form slot 40 therebetween. As shown in FIG. 3, slot 40 extends forwardly from the proximal ends 42 and 44 of the prongs to wall 46.

Figure 5:
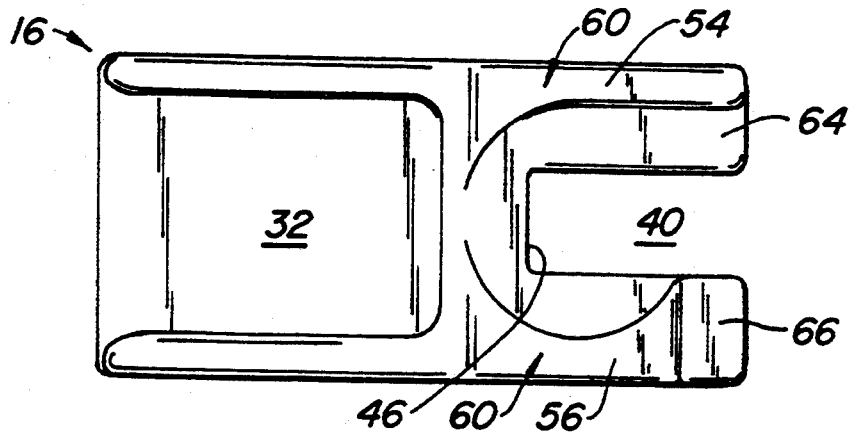
FIG. 5 is a bottom plan view of the tooth shown in FIG. 3.

Slot 40 preferably is rectangular in shape with wall 46 being substantially planar, as shown in FIGS. 3 and 5, to cooperate with a square shanked fastener. That is, fastener 18 preferably is a carriage bolt having a square upper shank portion 48, which is dimensioned to fit snugly in slot 40. The engagement of the square neck 48 with the side edges of slot 40 prevents the tooth from getting out of alignment with the shank plate and prevents relative rotation between fastener 18 and tooth 16.

Each prong has a top face 50, 52 and a bottom face 54, 56. Each face pair 50, 52 and 54, 56 preferably forms a substantially flat mounting surface 58, 60 for mounting the proximal portion of the tooth to a shank plate as will be discussed in more detail below. Prongs 36 and 38 also have depressions formed therein to form bolt head seating surfaces 62 and 64 adjacent or around slot 40 (see, e.g., FIGS. 3 and 5).

In accordance with the present invention, a fastener, such as a bolt and nut fastener, and a locking lug which extends from each tooth are used to secure each tooth to a respective shank plate. Accordingly, each shank plate includes a bolt hole and a lug-receiving recess or through hole for each tooth to be mounted thereon. As exemplified in FIG. 3, shank plate 14 includes bolt hole 70 and lug recess 74. Fastener 18 extends through hole 70 so that nut 72 can be secured to the threaded end of the fastener to lock the proximal portion of tooth 16 against generally planar shank plate mounting surface 23. Lug receiving recess or hole 74 receives either lug 66 or 68 depending on the position of tooth 16.

Figure 6:
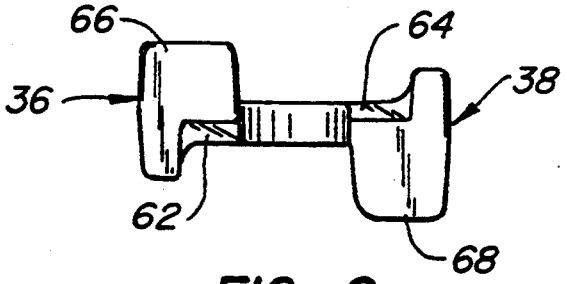
FIG. 6 is an end view of the tooth of FIG. 5.

Referring to FIG. 6, prong 36 includes lug 66 and prong 38 includes lug 68. Each lug extends beyond and generally perpendicular to the portion of the mounting surface 58, 60 adjacent thereto. When one of those mounting surfaces 58, 60 is seated against the corresponding mounting surface of the shank plate to mount the proximal portion of the tooth to the shank plate, the tooth and shank plate mounting surfaces abut one another while the lug extends into the lug recess such as recess 74. Specifically, lug 66 extends beyond mounting surface 60 and lug 68 extends beyond mounting surface 58. Lugs 66 and 68 each have a configuration generally corresponding to that of recess 74 and are dimensioned to snugly fit in that recess so that the lug always is sufficiently in contact with an inner wall(s) of the recess to prevent relative movement therebetween and transfer forces from the tooth to the shank plate. In this way, stress transfer through the bolt is minimized, thereby enhancing the life of fastener 18. That is, the interlock between the lug and the shank plate reduces the load on the fastener.

As shown in the drawings, each lug preferably is tapered to provide the desired fit within a respective recess 74. Although a lug having a generally rectangular sectional configuration is shown, it should be understood that other configurations can be used without departing from the scope of the present invention. For example, the lug can have a circular, triangular, pentagonal or hexagonal cross section.

Referring to FIGS. 3–6, the preferred arrangement of locking lugs for a reversible tooth is shown. Specifically, locking lug 66 extends from the bottom of prong 36, while locking lug 68 extends from the top of prong 38. Thus, when tooth 16 is positioned with top face 30 of the tooth facing upwardly as shown in FIG. 3, lug 66 cooperates with recess 74. However, when the tooth is reversed such that bottom face 32 of the tooth faces upwardly, lug 68 cooperates with recess 74. Thus, the configuration of lugs 66 and 68 preferably are essentially identical.

Figure 4:
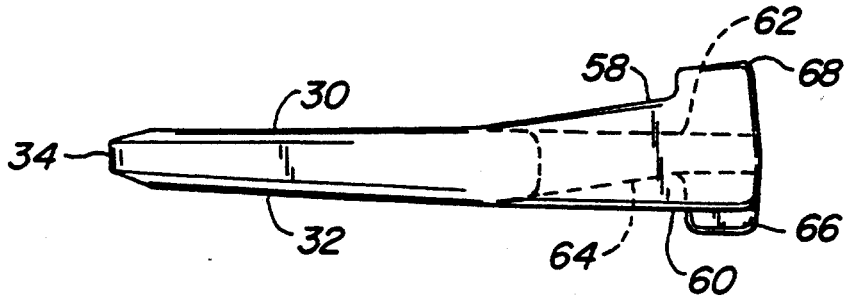
FIG. 4 is a side view of the auger tooth shown in FIG. 3.
Figure 7A:
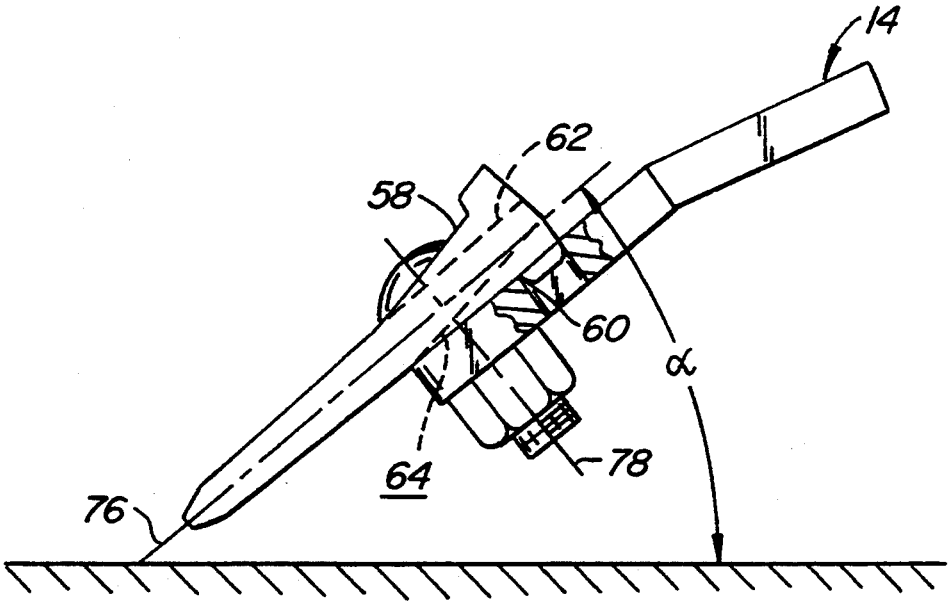
FIG. 7A is a side view of the tooth of FIG. 5 mounted to a shank plate in a first position.
Figure 7B:
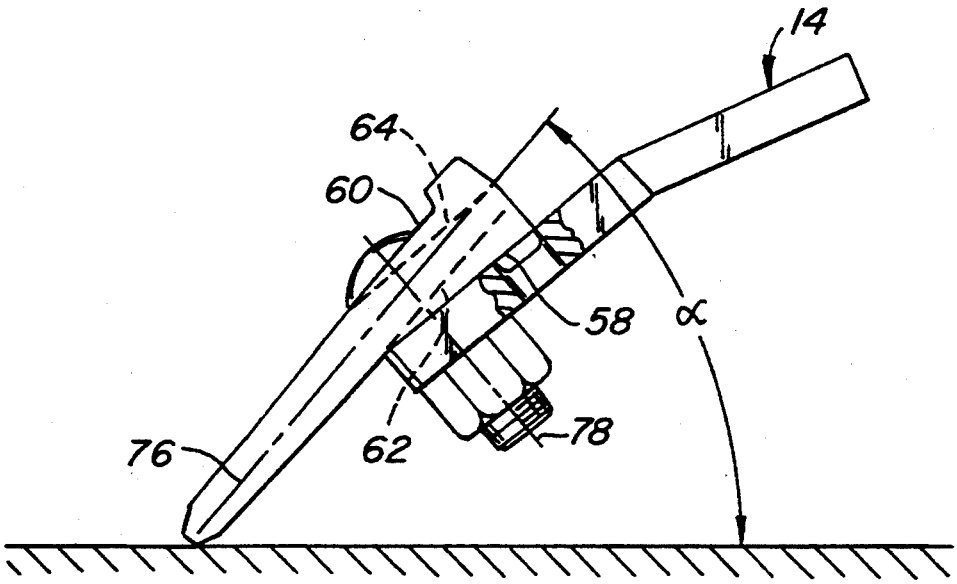
FIG. 7B is a side view of the tooth of FIG. 5 mounted in a reversed position.

Referring to FIGS. 3, 4, and 7, the mechanism for varying the attack angle of the tooth will be described. As shown in the drawings, mounting surface 60 is generally coplanar with bottom face 32 of distal portion 26, but mounting surface 58 is not coplanar with top face 30 of distal portion 26. That is, mounting surfaces 58 and 60 are substantially nonparallel. In this manner, the attack angle, designated with reference character $\alpha$, can be changed when the position of the mounting surfaces are alternated and the tooth is reversed from the position shown in FIG. 7A to that shown in FIG. 7B. In the preferred embodiment, the mounting surface 58 forms an angle with mounting surface 60 of at least about 5°, which results in a corresponding change in $\alpha$ of at least about 5°. In other words, when the tooth is reversed from the position shown in FIG. 7A to that shown in FIG. 7B, the angle formed between a plane 76 that bisects the top and bottom faces of distal portion 26 and a plane extending transversely through the shank plate and parallel to the longitudinal axis of fastener 18 as designated by reference numeral 78, for example, changes by an amount equal to the angle formed between the mounting surfaces 58 and 60.

The orientation of the bolt seating surfaces constitutes another important aspect of the invention. Specifically, bolt seating surface 62 is substantially parallel to tooth mounting surface 60, while bolt seating surface 64 is substantially parallel to tooth mounting surface 58. With this configuration, the bolt is maintained essentially perpendicular to the portion of the shank plate to which the tooth is mounted and the contact area between the bolt head and tooth and the nut and shank plate is maximized to enhance the securement of the tooth to the shank plate.

The above is a detailed description of a particular embodiment of the invention. It is recognized that departures from the disclosed embodiment may be made within the scope of the invention and that obvious modifications will occur to a person skilled in the art. The full scope of the invention is set out in the claims that follow and their equivalents. Accordingly, the claims and specification should not be construed to unduly narrow the full scope of protection to which the invention is entitled.

What is claimed is:

1. An excavating tooth comprising a distal portion and a proximal portion, said proximal portion including an aperture formed therein for receiving a fastener and an external face adapted for mounting to a shank plate, said external face being flat except for a projection extending beyond said external face for engagement with a recess formed in said shank plate.

2. The excavating tooth of claim 1 wherein said proximal portion includes another external face, said external faces facing in generally opposite directions and being nonparallel, said another external face having another projection extending therefrom for engagement with another recess formed in said shank plate.

3. An excavating tooth comprising a distal portion and a proximal portion, said proximal portion including laterally spaced prongs that form a slot therebetween for receiving a fastener, each prong having an external face adapted for mounting to a shank plate, said external faces forming a flat mounting surface except for a projection extending beyond said mounting surface, said projection shaped and sized for engagement with a recess formed in said shank plate.

4. The excavating tooth of claim 2 wherein said projection is tapered.

5. The excavating tooth of claim 3 wherein each prong includes a second external face, said second faces forming a second generally flat mounting surface, the other one of said prongs including a projection extending beyond said second mounting surface.

6. The excavating tooth of claim 5 wherein said mounting surfaces are nonparallel and said projections are tapered.

7. The excavating tooth of claim 5 wherein an angle of at least about 5° is formed between said mounting surfaces.

8. A shank plate assembly comprising a shank plate, an excavating tooth, and a fastener coupling said tooth to said plate, said plate having a flat tooth receiving surface and a recess formed therein, said tooth having a distal portion and a proximal portion, said proximal portion including an aperture through which said fastener extends for engagement with said shank plate, a face abutting said tooth receiving surface and a projection extending beyond said face and into said recess, said face being flat except for said projection.

9. The shank plate assembly of claim 8 wherein said projection is tapered.

10. The shank plate assembly of claim 8 wherein said projection has a transverse cross section that corresponds in configuration to that of said recess.

11. A shank plate assembly comprising a shank plate, an excavating tooth, and a fastener coupling said tooth to said plate, said plate having a substantially flat surface and a recess formed therein, said tooth having a distal portion and a proximal portion, said proximal portion including laterally spaced prongs through which said fastener extends, said prongs each having an external face abutting said substantially flat surface, each said external face being flat except one of said external faces having a portion extending beyond said external face and into said recess.

* * * * *